United States Patent [19]

Rath et al.

[11] 3,991,589

[45] Nov. 16, 1976

[54] AIR CONDITIONED TRANSPORT OF PRODUCE

[75] Inventors: Eric Rath, La Jolla, Calif.; George C. Mauder, Jr., Brooklyn, N.Y.

[73] Assignee: Frigitemp Corporation, New York, N.Y.

[22] Filed: Aug. 15, 1972

[21] Appl. No.: 280,815

Related U.S. Application Data

[63] Continuation-in-part of Ser. No. 243,695, April 13, 1972, Pat. No. 3,958,427.

[52] U.S. Cl. ..... 62/62; 62/91; 62/239

[51] Int. Cl.[2] ..... F25D 17/06

[58] Field of Search ..... 62/239, 274, 287, 91, 62/78

[56] References Cited

UNITED STATES PATENTS

| | | | |
|---|---|---|---|
| 3,246,592 | 4/1966 | Rath | 62/239 X |
| 3,412,571 | 11/1968 | Bolynn | 62/374 |
| 3,521,459 | 7/1970 | Rath | 62/78 |
| 3,611,738 | 10/1971 | Maurer et al. | 62/64 |
| 3,699,870 | 10/1972 | Cantagallo et al. | 62/239 X |
| 3,722,230 | 3/1973 | Scott et al. | 62/240 X |

*Primary Examiner*—William E. Wayner
*Assistant Examiner*—Ronald C. Capossela
*Attorney, Agent, or Firm*—Herbert C. Schulze

[57] ABSTRACT

This is a method and device for carrying fresh produce in a fresh condition by barge upon waterways and particularly is characterized by a unique compartmentalized arrangement encompassing two air conditioning units and a single divisible produce compartment in which produce may be placed on pallets, wherein some of the pallets are utilized cooperatively with the air conditioning units to form plenum chamber ducts for the dispersion of the conditioned air.

This air-conditioned barge is further characterized by a unique air-conditioning apparatus employing alternately and optionally air or water cooling of the refrigeration coils of the air-conditioning unit.

2 Claims, 10 Drawing Figures

AIR CONDITIONED TRANSPORT OF PRODUCE

CROSS REFERENCE TO RELATED PATENT APPLICATIONS

This application is related to, and a continuation in part of, co-pending application, Ser. No. 243,695, filed Apr. 13, 1972, now U.S. Pat. No. 3,958,427.

This application may be considered related to the following listed patent applications heretofore filed by one of the co-inventors, Eric Rath:

| | |
|---|---|
| Serial No. 141,956 | Filed: May 10, 1971 |
| For: Method for Storing and Transporting Food In a Fresh Condition (Application for Reissue of United States Patent No. 3,521,459, now U.S. Pat. No. Re 27,457 | |
| Serial No. 164,568 | Filed: July 21, 1971 |
| For: Method and Device for Storing and Transporting Food in a Fresh Condition, now abandoned; | |
| Serial No. 209,082 | Filed: December 17, 1971 |
| For: Fresh Produce Container Atmospheric Maintenance Unit, now U.S. Pat. No. 3,754,813 | |
| Serial No. 248,154 | Filed: April 27, 1972 |
| For: Method and Apparatus for Controlling the Atmosphere of a Storage Container | |

BACKGROUND OF THE INVENTION

1. Field of the Invention

This invention is in the field of transport of fresh produce and it is particularly in the field of transport of fresh produce by barge on waterways in conjunction with air conditioning units carried by such barge for maintaining the fresh condition of such produce.

2. Description of the Prior Art

There have been many air conditioned and/or air cooled or refrigerated fresh food containers in use, some of which have been the subject of patents. Some devices used in caring for fresh food containers are designed to be carried aboard ships; there are fresh food containers designed to be carried upon land vehicles; and some containers are so arranged as to be susceptible of being transported first upon land vehicles and then upon vessels.

The present invention however, is in the unique field of a method and a combination with a barge of an arrangement suitable for transporting fresh food, by barge, either from initial point of production to point of destination, or intermediate other transport means or points. Up to now, attempts at conditioning the atmosphere of a barge for such use has been limited to cumbersome and ineffective blowing of air into a barge from a deck-mounted blower, or the like, which does little, if anything, to maintain proper conditions for fresh produce; and, our co-pending application, Ser. No. 243,695, filed Apr. 13, 1972, now U.S. Pat. No. 3,958,427 is in the specific field of an air conditioned barge; we have now developed an improved method and apparatus, which incorporates features of said co-pending application and adds to the invention, particularly in the method of cooling the refrigerant. Except as outlined, we know of no art in which any attempt has been made to truly air condition a barge of produce effectively and to provide, at the same time, a plenum chamber distribution of conditioned air through the produce within the barge.

SUMMARY OF THE INVENTION

It is customary to transport much fresh produce from point of harvest, or any other suitable point, to the destination, to a point of storage, or other use, by water and barges. This is an economical means for such transport in many locations. One major problem in such transport, however, is spoilage of the produce.

Many barges used for produce transport are so constructed that they may be stacked one upon another. This has also placed a limitation upon the ability to condition the barges, or to move fresh air through them, since the attempts at conditioning have been aimed at the deck-mounting of large blowers, and the like, which makes it impossible to stack economically without a large space between the individual stacked barges.

It has been deemed most desirable to successfully effect proper conditioning of the atmosphere within and about the produce in a barge so that such produce may be maintained in proper condition for relatively long periods of time while remaiing in such barge. Likewise, it has been deemed most desirable to condition the air within barges containing produce, since, in many instances, the regulations of the U.S. Department of Agriculture require that produce be maintained at a certain lowered temperature for given periods of time in order to effectively kill any fruit flies which may be present in such produce before entry into United Stated commerce. It is were possible to maintain such produce within barges in proper condition, as outlined, it would be possible to obviate the problem of spoilage and, also, possible to obviate any intermediate storage situations for produce during such time as the fruit fly control, as heretofore mentioned, was effected.

Among other problems in connection with the proper conditioning of air within barges, is the ever present problem of sea water, or other water upon which the barge is being transported, being carried into the fan or other conditioning unit, due to the necessity to have air circulation about such unit. This has been particularly difficult in connection with the type of barge which stacks one upon another, and there has been, up until our invention, a total lack of any effective means to circulate air as required, but at the same time, to eliminate the danger of water coming into the unit from the deck, or otherwise. Also, the air, itself, in many instances, is not fully suitable for cooling the air conditioning coils, and the like, due to such circumstances as: severe humidity conditons; adverse surface conditions of the water upon which the barge is traveling; storms; and other such circumstances which make the usual air cooling of the coils of the refrigeration units undesirable, or which would have an adverse effect otherwise upon the air conditioning unit or the coils. Our new development in this field, and part of our invention herein, includes, among other things, a unique automatic opening and closing louver system for the circulation of air, together with unique intake system in which provision is made to trap and separate any water which might wash over the deck; additionally, we have developed an alternate method of cooling the refrigeration coils which, is as recognized by those skilled in the art, is a very critical phase of the air conditioning process. Our new method and apparatus includes the alternate use of a unique system employing a closed circuit water cooling system and apparatus which may be utilized alternatively with the air cooling system to provide appropriate water cooling of the refrigeration coils. Many extremely difficult problems exist in connection with such a water cooling system, including the fact that if the coils were to be immersed in salt water, and already being warm, substantial deposits of salts carried in the ocean and other waters would collect very quickly.

At the same time, fresh water systems for cooling the coils are generally not practicable because of the necessity of cooling the water itself after it has taken the heat from the coils, for example, by two cooling towers, or the like, as are commonly used.

We have now developed and discovered a system by which we can effectively use a closed system, fresh (or slightly brackish) water to cool the refrigeration coils by spraying such water over the coils in a completely closed unit and recirculating the cooling water through a chamber which is in contact with the water upon which the barge is floating. Thus, this water, in itself, is maintained in a cooled condition, but at the same time is maintained in its fresh condition, or slightly brackish, or, with other chemicals as may be desired, for maintaining the coils in proper condition under water cooling.

By combining the features of this cooling system with the alternative provision for air cooling, we have now been able to make one unit which can accommodate to all conditions, and one system, which can accommodate to all conditions, including all of the desirable features and eliminating the undesirable problems heretofore encountered, as herein outlined. The alternate cooling arrangements included within the one method and apparatus make it possible to maintain constant cooling of the produce within the barge, whether the barge is in water, out of water, in stormy or unfavorable conditions, and the like. This now accomplishes a maximum operating desirability method and apparatus.

We have now developed a method and combination effective for the care of fresh produce within barges under virtually all conditions. We have alleviated various problems heretofore encountered in a most effective and unique manner. We have arranged for the division of the barge during times of air conditioning into two longitudinal compartments by the addition of a plastic sheet, or the like, running longitudinally the length of the barge and hanging from the top deck to the bottom of the barge and within the barge. We have placed one air conditioning unit on one side of the barge and at one end, and a second air conditioning unit at the other end of the barge and at the other side. This unique placement balances the barges at all times. Likewise, we have placed a power unit and fuel tank in the end of the barge and near the opposite side from the air conditioning unit to service each of such air conditioning units. And, we have arranged for the elimination of contamination and flooding of the conditioning unit by water, as previously mentioned, and by a unique telescoping and sliding louver arrangement for air exit, and a unique double-walled air intake arrangement with water-trapping ability. As previously stated, we have provided a radially superior system to cool the refrigeration coils by the closed circuit water system, working in combination with the air system as previously outlined. The result in an overall balance heretofore not achieved with this possibility of air conditioning the cargo, under any and all conditions of the atmosphere and surroundings.

We have further arranged the air conditioning duct from the air conditioning unit in each instance so that it discharges the conditioned air through the pallets upon which produce is carried and stored within the barge, in which case, the pallets become an extension of the air conditioning ducts so as to allow a plenum chamber effect to be achieved wherein the conditioned air rises gradually throughout the entire produce and returns to the upper part of the air conditioning unit for further cooling and conditioning.

It is an object of this invention to provide a method and means to maintain fresh produce in proper condition within a barge;

It is a further object of this invention to provide such method and means wherein the pallets upon which produce is stored within the barge are utilized to form ducts for the transport of air from the air conditioning unit;

It is a further object of this invention to provide such method and means in such manner that the barge will be stable in the water whether loaded or empty;

Another object of this invention is to provide a method and means for air and/or water cooling of the refrigerant used;

Another object of this invention is to provide a method and means for cooling the refrigerant in which the water in which the barge is operating is used as the ultimate cooling with an intermediate closed circuit system;

It is a further object of this invention to provide a method, means and combination as described with appropriate power and conditioning arrangements and detection equipment to maintain produce within a barge while satisfying certain agricultural control requirements.

The foregoing and other objects and advantages of this invention will be clear to those skilled in the art upon reading the following description of a preferred embodiment in conjunction with, and with reference to, the appended drawings.

DESCRPTION OF A PREFERRED EMBODIMENT

Figure 1:
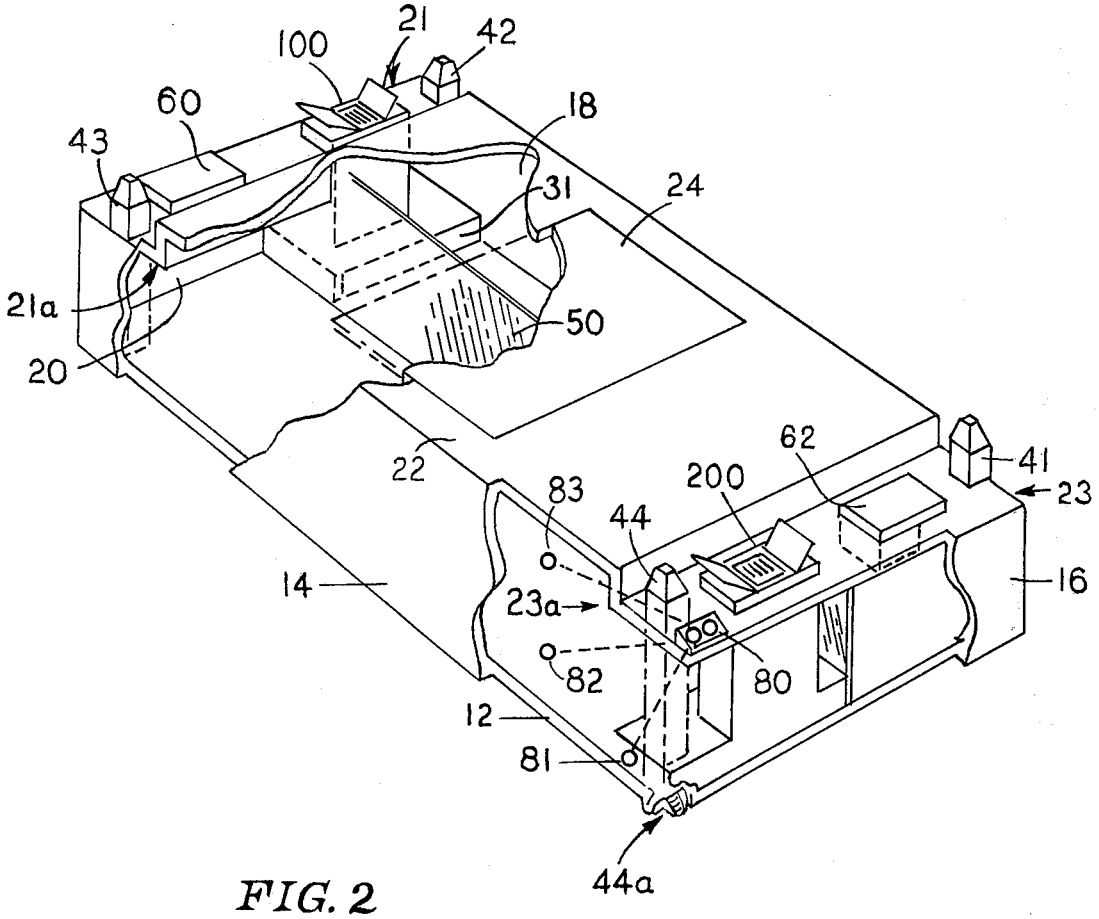
FIG. 1 is a partially broken away perpsective of a preferred embodiment of a barge embodying the means of this method.

It will be observed from the Figures that the barge illustrated is relatively conventional in construction and consists of an essentially flat bottom 12 with sides and ends 14, 18, 16 and 20, together with a top deck 22 having a suitable opening enclosed by a hatch 24. The construction may be of welded steel, or the like, as is well-known in the barge industry and no attempt has been made to indicate the method of joining the various portions together, which are of no consequence in this particular invention. The top of the barge at each end will have a slight offset portion, as indicated at 21 and 23, with general configuration to provide the slightly lowered elevation at that position, as indicated at 21*a* and 23*a*. The reason for the lowering of this area is to provide for the clearances as indicated and in order to allow the upper portion of the air conditioning units 100 and 200 to be elevated essentially as indicated and the fuel tank and power combinations 60 and 62 to be located as indicated for accessibility. Such elevation also allows for the convenient stacking of one barge upon another by means of the corner posts 41, 42, 43 and 44, wherein the posts stack upon one another and thus the barges stack upon one another wherein the upstanding somewhat pyramidal shape of each of the posts at its top can enter and nest into the inverted pyramidal cavity at the lower end of each of said posts such as at 43*a* and 44*a*. The stacking of barges in this manner is not new as barges have been stacked in this manner heretofore.

In this particular instance, the offset of the deck at either end and as illustrated at 21, 21*a*, 23 and 23*a*, particularly accommodates for the proper mounting of the refrigeration and air conditioning units 100 and 200 and the fuel and power units 60 and 52. Likewise, this mounting allows the possibility of indicating panels, or the like, such as illustrated at 80, in such condition that they are easily accessible, but cannot be damaged by elements upon the deck or coming close to the deck. In this particular instance, the control panel 80 is shown connected by dotted lines to sensing elements 81, 82 and 83 throughout the barge. It is noted that only two dials have been shown on the control unit 80 while three sensing elements have been illustrated at 81, 82 and 83. There is no particular necessary relationship between the number of sensing elements and the number of dials, as each dial may operate for more than one sensing element and each sensing element may affect more than one dial. As an example, one of the dials illustrated could indicate a median between 81 and 83, which could be respectively sensing the condition of the freshly air conditioned air and the return air. Likewise, the element 82 could be sensing an intermediate condition or could even be sensing the condition within the produce, such as under conditions of control where agricultural requirements may require produce to be kept at a particular low temperature for a given period of time in order to completely eliminate any possibility of fruit fly, or the like, entering with the produce.

Figure 2:
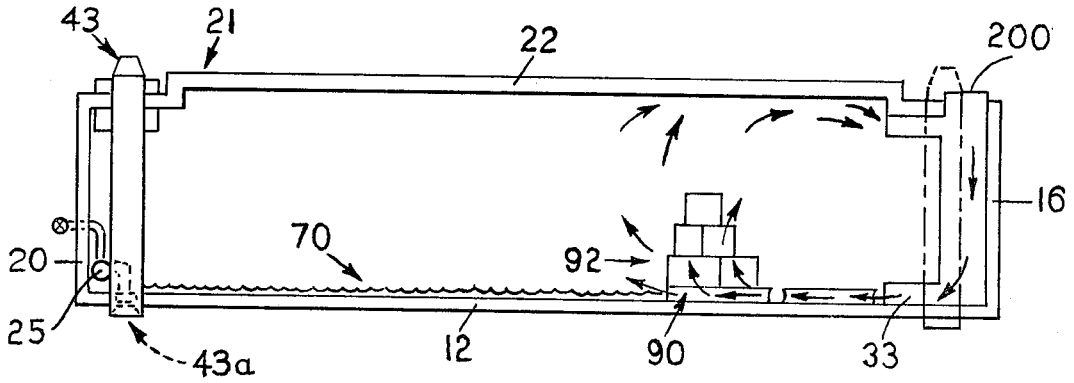
FIG. 2 is a side elevation of the embodiment shown in FIG. 1 with the side removed and some schematic indication of cargo and air flow within the unit.

In FIG. 2 there is particularly illustrated the air flow and this entire method is deemed unique. It will be observed that the duct 33, which receives the freshly refrigerated and otherwise conditioned air from the air conditioning unit 200 is so arranged that at its exit it aligns with pallets upon which the produce is stored and carried, which pallets are upon the floor of the interior of the barge during produce storage therein. As will be recognized by anyone familiar with pallets, these pallets would normally have longitudinal members, which would be so aligned as to run the direction of the length of the vessel and thus in the direction of the flow of the air from the air conditioner. Between each set of longitudinal members, a duct or a series of ducts will be formed through which the air from the air conditioning unit will travel as indicated schematically by the arrows in FIG. 2. Such pallets will also, normally, have openings of one type or another in their upper surface through which the conditioned air traveling through the lower portion of the pallet and between the cross members thereof may rise and thus circulate through and about the produce stored upon such pallets.

In the particular instance illustrated, the pallets will be for example 90 and produce may be in crates or the like, the details of which have not been shown, which crates may take a variety of shapes and are illustrated generally by the numeral 92.

As a result of cooling the air, there will be condensate from the air conditioning operation, as is well-known in the air conditioning art. The condensate is water condensed from the air as it is cooled and circulated. This condensate is allowed to collect upon the floor of the barge as a thin bath or layer of water 70 in which the pallets will be resting. There is an importance to allowing the collection of this water on the bottom of the barge, which has not previously occurred to others in this field, in that by maintaining this slight film of water in which the pallets rest, the air conditioned air, which has been greatly cooled, will not become overly dry, and the right balance of moisture within the air may be maintained. Such is not true of other systems or efforts to condition the produce air within a barge and the allowing of this slight bath of water from the condensate resulting from the air conditioning process is unique. A bilge pump 25 is provided so that as desired all, or a portion of the water 70 in the bottom of the barge may be removed in order to adjust and control humidity and the humidification process; thus, maintaining the produce within an atmosphere of the correct desired humidity for the particular conditions of the produce itself and the ambient external conditions. No details of the bilge pump are shown, but it will be clear to those skilled in the art that such a pump may be so placed and its operation may be controlled by a humidity indicator so that the activation thereof will be dependent upon the humidity within the barge, if desired.

In operation, the air conditioning units 100 and 200, each of which will include a fan, or the like, to move the air, will draw in air at its uppermost portion, as indicated by the direction of the arrows flowing under the upper deck 22 of the barge. This air will then be forced downward as it is conditioned and as indicated by the direction of the arrows and through the duct 33, from whence it will travel through the ducts formed between the cross members of the pallets 90 and will travel the length of the barge, at the same time, passing over the water bath 70. The air will, throughout its course, filter upward, as indicated by arrows, so that some of the air will go through the entire barge; some will filter up through all of the produce and then all will return in an air flow as indicated.

Utilizing the pallets in this manner will cause them to be acting as plenum chambers by which a necessary pressure differential will be obtained to create an even and direct flow of the air and the continuous process of cooling.

It is understood that normally the produce will be loaded within the barge, the plastic curtain 50 will be placed in position, and both the conditioning units 100 and 200 will be activated. Any desired controls such as at the control unit 80, may be brought into play and by the use of appropriate sensing devices 81, 82 and 83, the appropriate condition for the particular produce or fruit fly control requirement may be achieved. The appropriate conditions as desired will be known to those skilled in the art and will include different temperature settings for different classes of food and will require the continuous existence of a particular temperature condition for the fruit fly control as required by the U.S. Department of Agriculture, or others. These requirements are known to those skilled in the art of produce transportation and it will be clear that specific conditions required may be maintained for such periods of time as are deemed desirable.

A unique and very important problem encountered in attempts to freshen air within barges, is the difficulty of maintaining the integrity of the units being utilized to condition the air as against the action of waves, and the like, breaking over the deck of the barge occasionally.

Additionally, all attempt to provide some sort of complex superstructure arrangement have been doomed to failure because of the necessity of stacking the barges upon the corner posts as previously mentioned.

We have overcome this problem and are now able to properly cool the air conditioning units' coils by circulation of large volumes of air. We are able to do this with adequate arrangements for stacking, and safeguards against the infiltration of water by means of a very unique combination of elements as will be herein described.

It is important first to note, that we are showing the elements schematically, since we are not claiming uniqueness of air conditioning as such and all persons skilled in the art are familiar with the actions and operations of air conditioning units. For this reason, all details of this nature have been eliminated.

Figure 3:
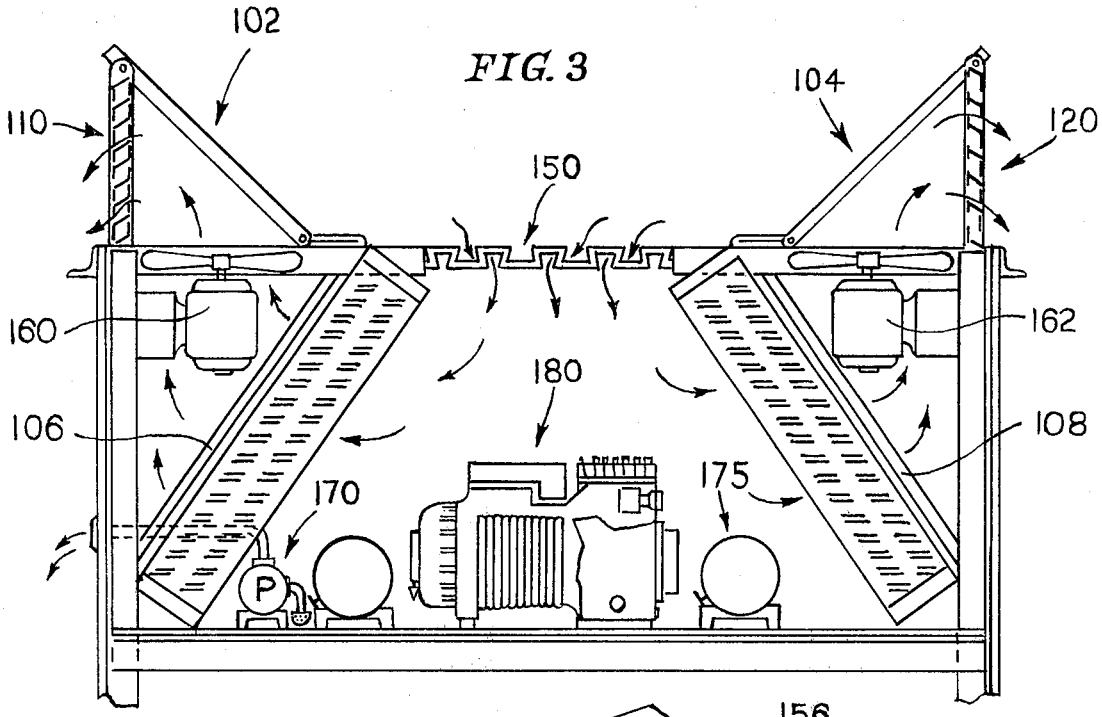
FIG. 3 is an enlarged, partially schematic view of a typical conditioning unit as used in the embodiment shown in FIG. 1 and FIG. 2, with the end removed to illustrate the elements of construction for ventilation of the condenser coils of the conditioning unit.

There is shown in FIG. 3 a typical air conditioning unit for one side of the barge. It is seen that the portion of the unit shown is the condenser coils, together with the compressor and tanks, and the like.

The compressor unit or units 180, together with suitable tanks such as 175, are located upon a platform below the deck of the barge. Beneath the portion specifically illustrated in FIG. 3, will be the cooling arrangement for the air being recirculated within the barge, and this will be clearly understood by those skilled in the art with no additional explanation.

Blowers 160 and 162 are provided to circulate air through the coil system 106 and 108 respectively. The air is blown upwardly and outward through the louvered arrangements 110 and 120. The air intake is through the air intake arrangement 150, the details of which will be explained below.

Figure 4:
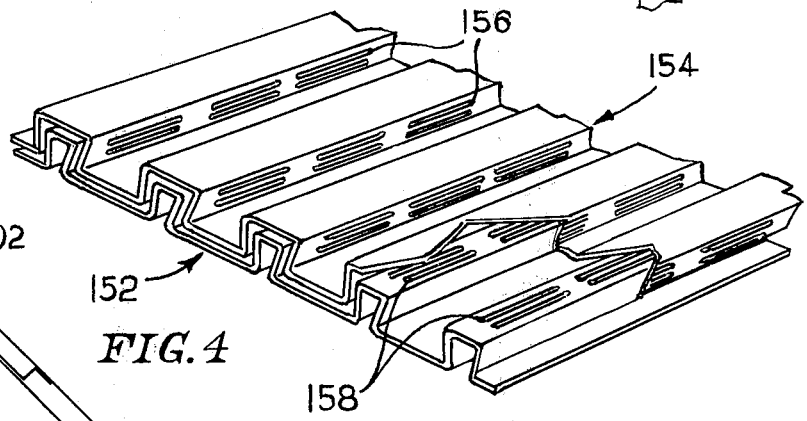
FIG. 4 is an enlarged, partially broken away view of a typical portion of the air intake arrangement for the condenser coils as shown in FIG. 3.

The air intake opening is constructed or a series of intercombined units as particularly illustrated in FIG. 4. It will be seen in FIG. 4, which is an enlarged, partially broken away view of a portion of 150 from FIG. 3, that there is one basic item 152 of sheet metal, or the like, bent in approximately the configuration shown and having a multiplicity of openings such as 158 in each of the upper flat areas.

Nested above the unit 152, is a unit 154. This unit, again, has a configuration substantially as shown and with a series of openings 156 in its edges in a configuration such that such openings are upon an angular relationship of less than 90° with relationship to the horizontal top and bottom portions.

Thus, in the event that water should break over the top of the unit, very little, if any, of the water would enter through the openings 156. Any water which did enter through the openings 156, however, would drain down onto the flat trough-like arrangements of the lower element 152. Air, however, would be drawn through the openings 156 upward and around down through the openings 158 and thus would have been separated from the water which will then drain out through the troughs formed in the lower portion of the unit 152. Any water which has splashed over the top and not gone through the slots 156 would, of course, drain through the flat troughs on the unit 154.

This water will then accumulate in a trough, not shown, at the end and will be drained out by gravity, or by the action of a bilge pump, not shown.

Additionally, a pump 170 is provided within the compressor compartment in the event that any water should, in spite of these precautions, enter that compartment, so that it may readily be pumped out in a manner well-known to those skilled in the art.

It is, of course, necessary to preserve the watertight integrity of this system, to prevent water from entering through the air exhaust portion, also. This has been accomplished by an upstanding series of louver arrangements 110 and 120, each of which consists of a series of elements formed of sheet metal, or the like, and bent at the angular relationship particularly shown in FIG. 6. At each end of the series of louver arrangements 114 is a channel 116 to provide an overall rigid unit. A channel is likewise provided at the bottom and at the top, as indicated in FIG. 5 in order to make one overall relatively rigid louver unit.

It will be seen that the effect of this louvered arrangment is to provide a passage for air being blown out by blowers 160 and 162 respectively so that in the event there was any splashing of water on the deck against this air escape arrangement, such water would have a relatively impossible task to find its way into the compressor compartment. The angular direction of the individual louvers 114 is such that the water will tend to drain back outside on the deck.

A deck cover 102 and 104 respectively is provided for each of the openings above the exhaust fans. This deck cover is mounted by a pin or hinged arrangement (details not shown) at or near the top of the louver arrangements 110 and 120 respectively. At its other end, it slides in a track 192 within a rigid mounting bar 190 and by means of a bolt or pin 194, by means which will be known in the art.

Figure 5:
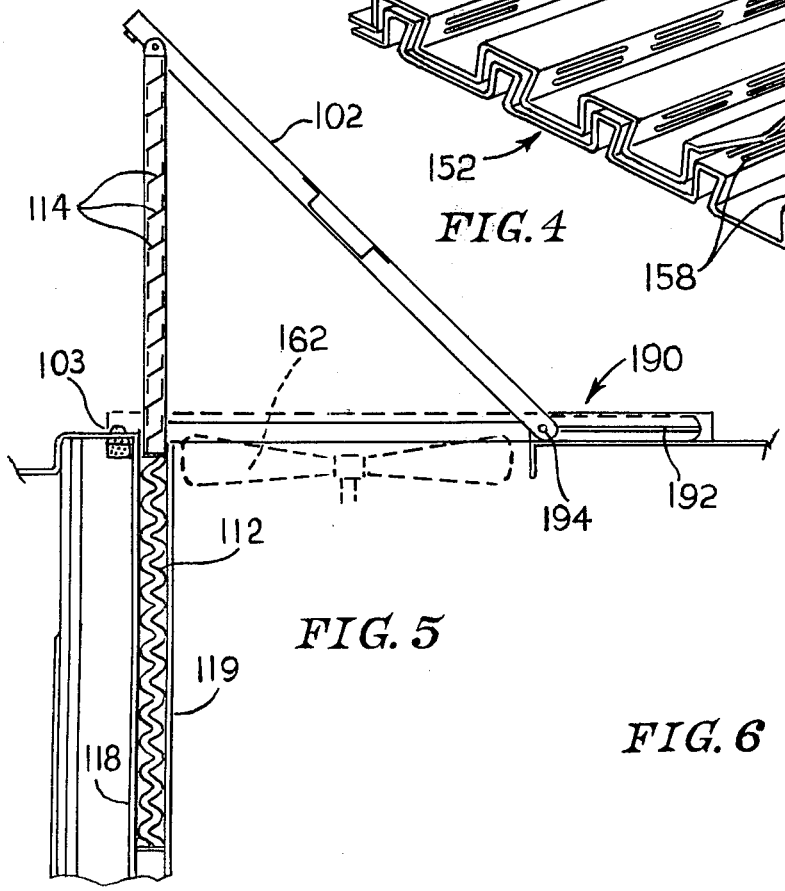
FIG. 5 is an enlarged, partially opened, schematic view of the air exhaust system shown in FIG. 3.
Figure 6:
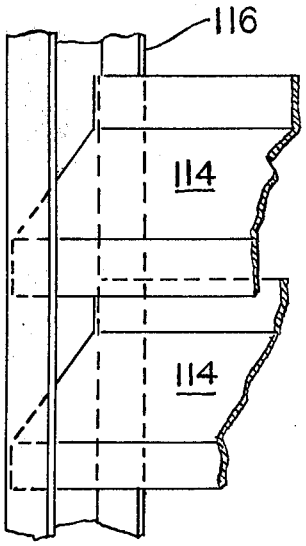
FIG. 6 is an enlarged view of a portion of one end of the louvered air exhaust arrangement of FIGS. 3 and 5.

A spring, or the like, 112, is mounted in a rectangular well formed of sheets of steel, or the like, 118 and 119, as indicated particularly in FIG. 5. When one barge is stacked upon another with this arrangement, the covers 102 and 104 are pressed downward by the barge from above and the louver arrangements 110 and 120 disappear within the respective wells.

To avoid the possibility of inadvertent operation of the equipment when the louvers are closed, a contact switch, such as a microswitch, or the like, 103, will be provided to disconnect the power to the compressor unit 180 when the louver arrangement 114 has disappeared within its well and the contact switch is contacted by the covering element 102. It is understood that a like switch may be mounted in conjunction with the unit 120.

It is understood, of course, that the air circulating within the barge, and as shown by the arrows in FIG. 2 specifically, will enter the cooling portion of the air conditioning unit beneath the compressor platform as shown particularly in FIG. 3. The air circulation described is the cooling air for the coils and not the air being circulated within the barge. As previously expressed, the details of the operation of an air conditioning system are known to those skilled in the art and, therefore, such details are not shown.

It should be especially noted that the ducts formed by the spaces between the pallet cross members could conceivably be formed in another manner, such as by a series of specially constructed ducts, and the like. In such instance, and in the event of the possibility of bulk loading of some products, such ducts would take the place of the pallets. While this is considered a possibility, it is to be noted that utilizing the pallets to supply the ducts for this purpose is an extreme advance in the art in itself in that it forms a completely cooperative arrangement between the produce and its carrier pallets, the barge, and the air conditioning unit.

FIGS. 7, 8, 9 and 10 illustrates a barge, very similar in construction to the one illustrated in FIGS. 1 through 6, and embodying many of the identical features, but in which there have been added the new and unique provisions for accomplishing the method of closed circuit water cooling of the coils.

Throughout FIGS. 7 through 10, some elements are shown which are essentially identical to the elements of FIGS. 1 through 6 and, for clarity, the reference number system of FIGS. 7 through 10 has been keyed to the reference number system of FIGS. 1 through 6. All reference numbers, where comparable and convenient to so do the same, in FIGS. 7 through 10 have been duplicated from FIGS. 1 through 6 with the addition of a 1, making such reference numerals, where convenient, a one thousand series. Additionally, other reference numerals not comparable, have been used, and any conflict between the numbers should be resolved in favor of a complete reference to the total number, and not an attempt to transpose from the other Figures.

Figure 7:
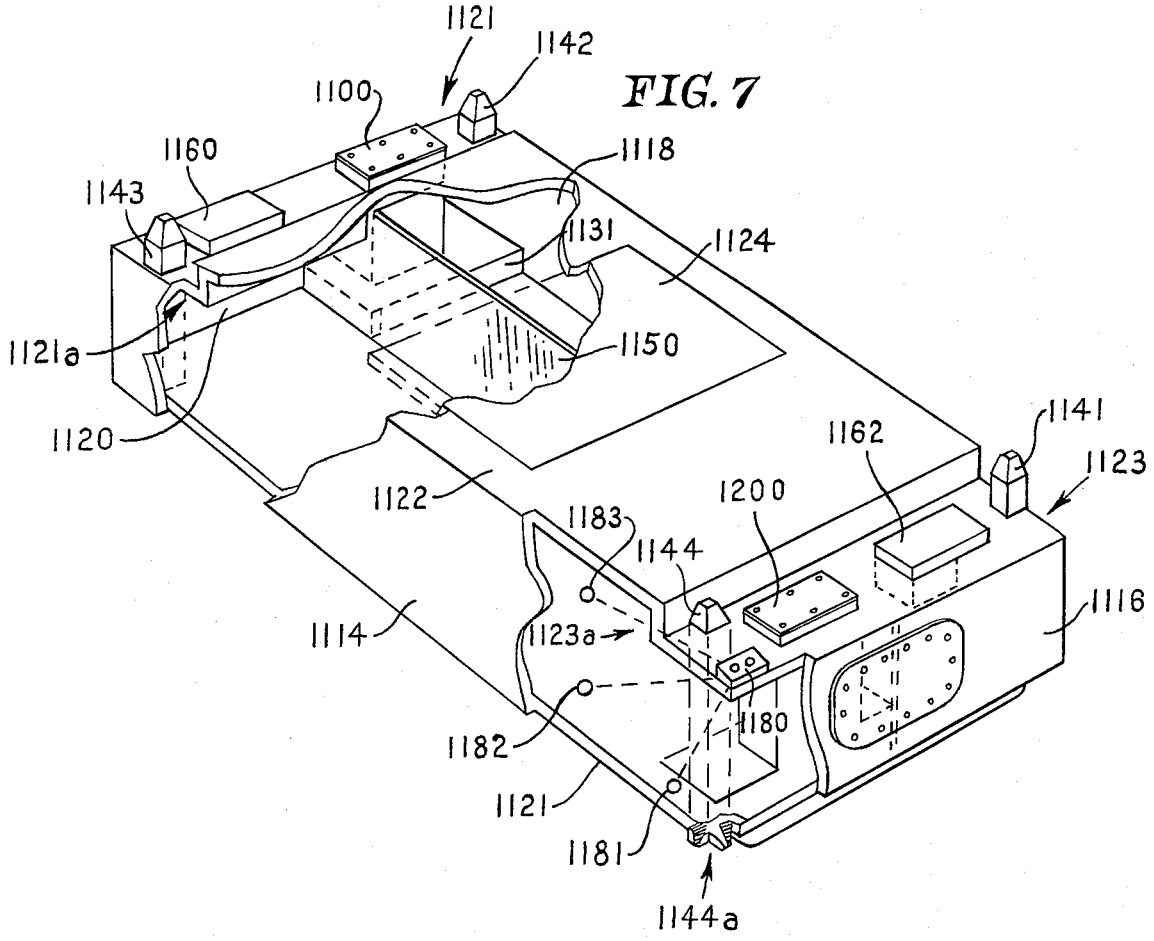
FIG. 7 is a partially broken away perspective of an alternate embodiment of a barge having features to practice the method of this invention.
Figure 8:
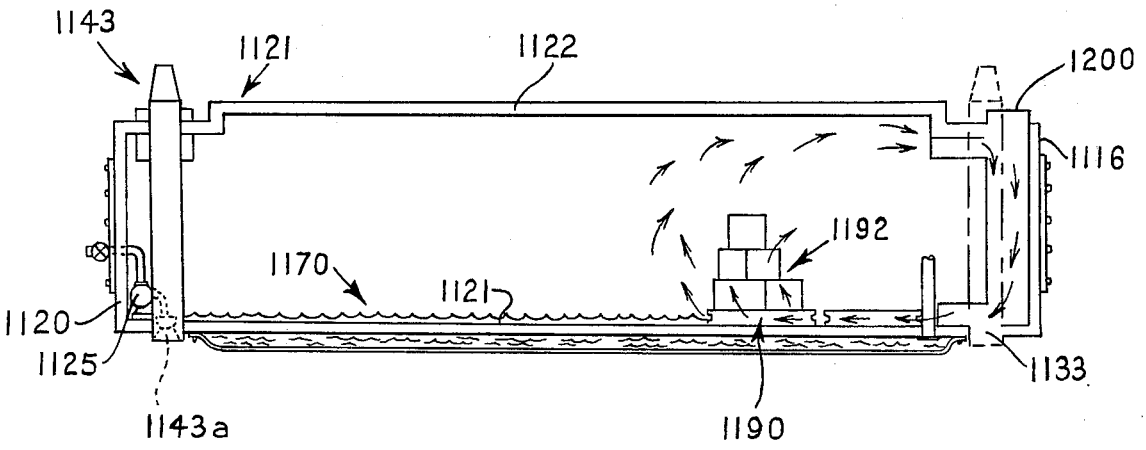
FIG. 8 is a side elevation of the embodiment shown in FIG. 7 with the side removed and some schematic indication of cargo and air flow within the unit as well as the cooling of the closed circuit water system.

Comparing FIGS. 1 and 2 with FIGS. 7 and 8, it will be clear that the following illustrated elements are essentially identical between FIGS. 1 and 2 and FIGS. 7 and 8 and therefore a repetition of the descriptions thereof will not be made:

| FIGS. 1 and 2 | FIGS. 7 and 8 |
|---|---|
| 12 | |
| 14 | 1114 |
| 16 | 1116 |
| 18 | 1118 |
| 20 | 1120 |
| 21 | 1121 |
| 21a | 1121a |
| 22 | 1122 |
| 23 | 1123 |
| 23a | 1123a |
| 24 | 1124 |
| 25 | 1125 |
| 41 | 1141 |
| 42 | 1142 |
| 43 | 1143 |
| 44 | 1144 |
| 43a | 1143a |
| 44a | 1144a |
| 33 | 1133 |
| 31 | 1131 |
| 50 | 1150 |
| 60 | 1160 |
| 80 | 1180 |
| 62 | 1162 |
| 70 | 1170 |
| 92 | 1192 |
| 90 | 1190 |
| 82 | 1182 |
| 81 | 1181 |
| 83 | 1183 |
| 100 | 1100 |
| 200 | 1200 |

With reference to FIGS. 7 and 8 by comparison to FIGS. 1 and 2, it should be observed that 1200, being a coverplate, has replaced the opening 200; 1201 is an access door into the air conditioning unit which was previously unnecessary in this exact form.

2110 is an interesting new element which comprises a chamber beneath the barge in which water is contained, which water bears a reference numeral 2111. There is also a pipe 2113 which connects the water chamber and the water 2111 with the air conditioning coil cooling unit as hereinafter described.

Figure 9:
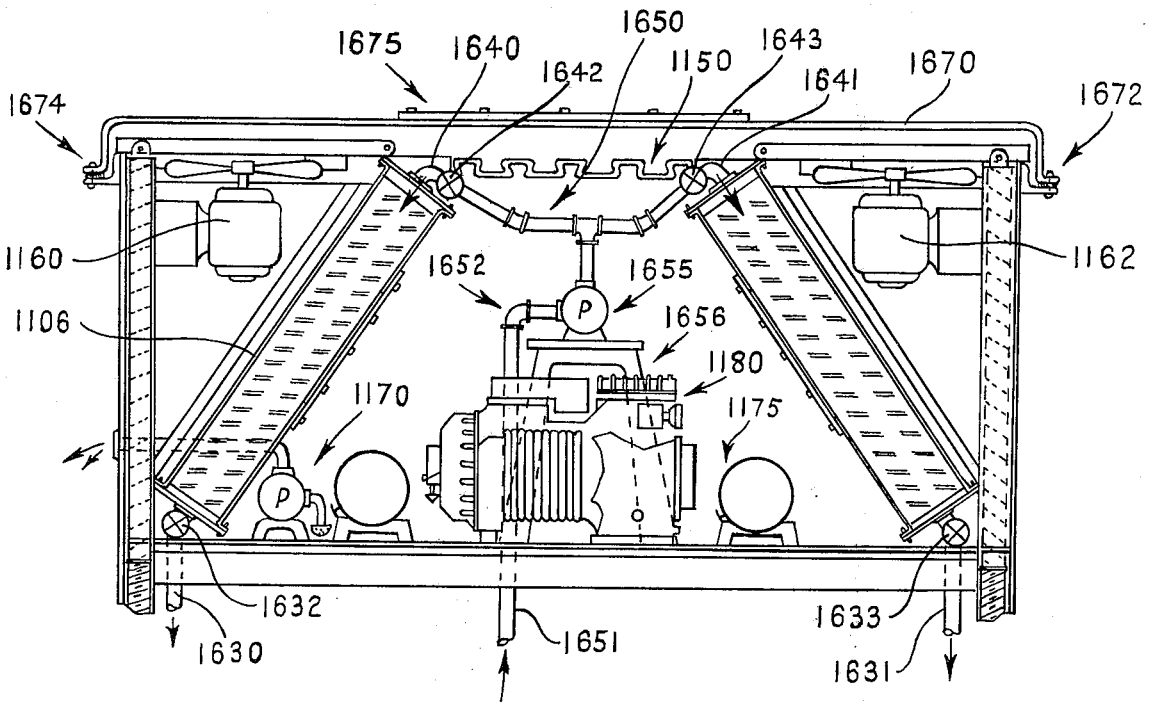
FIG. 9 is an enlarged, partially schematic view of a typical conditioning unit as used in the embodiment shown in FIGS. 7 and 8, with the end removed, and with certain elements partially schematic, partially broken away, and partially disassembled in order to illustrate the elements of construction for cooling of the condenser coils of the conditioning unit.
Figure 10:
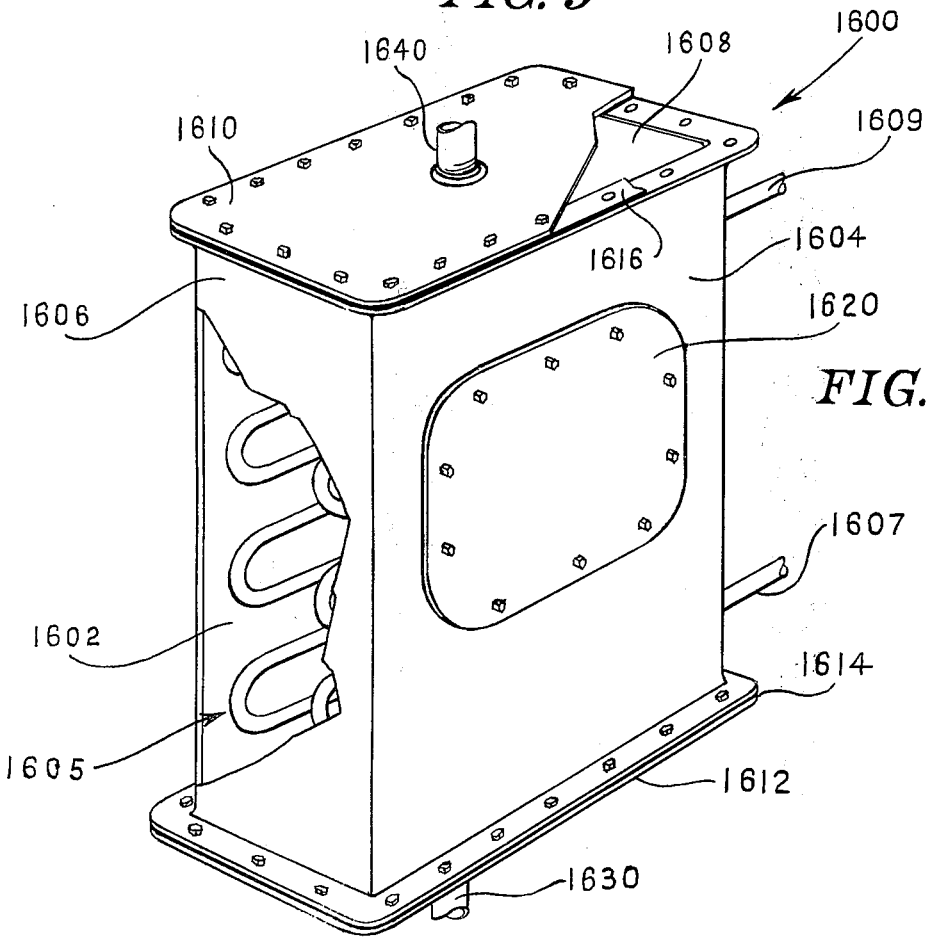
FIG. 10 is an enlarged, partially broken away, perspective of a method of construction of the portion of the closed circuit water cooling system for the air conditioning coils which actually cools the coils by the action of the water in the closed circuit.

Referring now to FIGS. 9 and 10, and to a certain extent comparing them to the representations units of FIG. 3, the following similar elements exist:

| FIG. 3 | FIGS. 9 and 10 |
|---|---|
| 160 | 1160 |
| 106 | 1106 |
| 150 | 1150 |
| 162 | 1162 |
| 170 | 1170 |
| 175 | 1175 |
| 180 | 1180 |

New elements have been introduced into FIGS. 9 and 10, and such elements are of importance in practicing the water cooling portion of this method and apparatus.

The element, generally 1600, shown particularly well in FIG. 10, is a completely enclosed system enclosing the cooling coils 1605 in a manner as indicated. The element 1600 has sides 1602, 1604, 1606 and one remaining side, not shown, but obvious. Additionally, there are a top and bottom unit 1610 and 1612, respectively, having suitable gaskets 1614 and 1616, as indicated, to insure a watertight connection. There is an inspection and repair opening 1620 provided in the side 1604 for access as may be desired.

A pipeline 1630 is provided in the end 1612 and a pipeline 1640 is provided in the end 1610. Through these lines an appropriate nozzles (known in the art and not shown), within, the water may be sprayed from one or both ends against the coils for cooling and removed through the bottom end (normally) 1630. If it seems confusing that the water might be sprayed and removed through the same opening 1630, this brief explanation is provided, which is to the effect that this could be a double pipe for such purpose.

The inlet and outlet pipes 1607 and 1609 for the refrigerant into the coils 1605, will be understood by those in the art and it is through these inlets that the refrigerant enters and removes itself from the cooling coils.

Referring particularly to FIG. 9, it will be observed that the element 1630 is a drainpipe for the cooling water with an appropriate valve 1632 for control thereof. The element 1642 is an inlet valve as is the element 1643 for its corresponding cooling effect on the other side, which again compares to elements 1631 and 1633 being the equivalent of 1630 and 1632. The piping arrangements 1650, 1640, 1641, and the like, are well-known to those skilled in the art. The cover 1670 with its access plate 1675 is bolted, or otherwise fastened, to a flanged arrangement as indicated to close the air inlet arrangements and provide a watertight seal on the top of the air conditioning area of the barge.

In operation, the water will enter the system through line 1651 drawn by pump 1655 through piping arrangements 1652 and distributed through general piping arrangement 1650 and the various other elements as heretofore described.

This operation should be clear to those skilled in the art in illustrating how the water system will cool the coils and be returned to its storage chamber at 210. This storage chamber, having contact to the water in which the barge is traveling acts as a bilge keel or the like and will be maintained in proper condition for the continued re-cooling of the coils.

When desired, the top and bottom 1610 and 1612 respectively of the unit may be removed, as well as the opening 1620 in order to provide air circulation as existing in the straight air circulation unit and which air circulation provision is combined within the present invention.

It will be apparent that all of the sides may be opened (not shown) in a manner similar to the opening of 1620, or for that matter, by complete disassembly of the covering unit so that alternate and/or complimentary air cooling and water cooling may be achieved.

We claim:

1. The method of transporting produce in a fresh condition in a barge comprising: storing fresh produce within a barge, cooling air by a refrigeration process having a cooling medium, extracting water as condensate from said air during said cooling; collecting said extracted water and storing it on the floor of said barge; forcing the cooled air under pressure along the floor of the inner portion of said barge and over the stored water and beneath the stored produce in such manner that the cooled air is humidified and a plenum chamber effect is achieved and a portion of such air circulates upwardly through the produce throughout the entire length of said barge; drawing the air so circulated through said barge and produce along the lower side of the deck of said barge back to the place of cooling of said air for further cooling and recirculation in the above manner, the water in which the barge is resting is utilized to cool the cooling medium for the refrigerant used in cooling the air.

2. The method of claim 1 in which the method for cooling the cooling medium for the refrigerant used in cooling the air includes a closed circuit of water coolant which is kept in motion and which closed circuit has a portion which passes in contact with the water upon which the said barge is supported.

* * * * *